US007226293B2

(12) United States Patent
Na et al.

(10) Patent No.: US 7,226,293 B2
(45) Date of Patent: Jun. 5, 2007

(54) BUILT-IN TYPE ANTENNA ASSEMBLY OF WIRELESS COMMUNICATION TERMINAL

(75) Inventors: Gi Lyong Na, Kyungki-do (KR); Wook Hee Lee, Kyungki-do (KR)

(73) Assignee: Samsung Electro-Mechanics Co. Ltd., Suwon (KR)

( * ) Notice: Subject to any disclaimer, the term of this patent is extended or adjusted under 35 U.S.C. 154(b) by 3 days.

(21) Appl. No.: 11/095,706

(22) Filed: Mar. 31, 2005

(65) Prior Publication Data

US 2006/0134942 A1 Jun. 22, 2006

(30) Foreign Application Priority Data

Dec. 21, 2004 (KR) ..... 10-2004-0109441

(51) Int. Cl.
*H01R 12/00* (2006.01)

(52) U.S. Cl. ..... 439/66; 439/700; 439/824

(58) Field of Classification Search ..... 439/66, 439/700, 824
See application file for complete search history.

(56) References Cited

U.S. PATENT DOCUMENTS

| | | | | |
|---|---|---|---|---|
| 5,427,535 | A | 6/1995 | Sinclair | |
| 5,807,123 | A * | 9/1998 | Spiegelaar et al. | 439/188 |
| 5,954,529 | A * | 9/1999 | Meller | 439/188 |
| 5,967,856 | A | 10/1999 | Meller | |
| 6,299,457 | B1 * | 10/2001 | Snyder | 439/66 |
| 2003/0179144 | A1 | 9/2003 | Takesako | |

FOREIGN PATENT DOCUMENTS

| | | |
|---|---|---|
| DE | 197 49 650 | 5/1999 |
| GB | 2 320 815 | 7/1998 |
| JP | 11-162592 | 6/1999 |
| JP | 2001-156513 | 6/2001 |
| WO | WO 01/24311 | 4/2001 |
| WO | WO 01/45213 | 6/2001 |
| WO | WO 02080304 | 10/2002 |
| WO | WO 2003/061061 | 7/2003 |
| WO | WO 2004/109847 | 12/2004 |

* cited by examiner

*Primary Examiner*—X. Chung-Trans
(74) *Attorney, Agent, or Firm*—Volpe And Koenig, PC

(57) ABSTRACT

Disclosed herein is a built-in type antenna assembly of a wireless communication terminal. The antenna assembly comprises a board, a case mounted on the board and having at least one disposing part formed through the case such that a portion of an upper surface of the board is exposed through the disposing part, an antenna member mounted on the case to radiate electrical signals from the board to the outside while receiving external signals, and a resilient part disposed within the disposing part to provide resilient force for maintaining contacts between an upper end thereof and the antenna member and between a lower end thereof and the board to electrically connect the board and the antenna member. The antenna assembly has a constant path of electrical signals and electric waves, providing uniform performance, and is reduced in the number of components, thereby reducing manufacturing costs while enhancing assembly efficiency.

9 Claims, 6 Drawing Sheets

BUILT-IN TYPE ANTENNA ASSEMBLY OF WIRELESS COMMUNICATION TERMINAL

RELATED APPLICATION

The present invention is based on, and claims priority from, Korean Application Number 2004-109411, filed Dec. 21, 2004, the disclosure of which is incorporated by reference herein in its entirety.

BACKGROUND OF THE INVENTION

1. Field of the Invention

The present invention relates to an antenna assembly embedded in a wireless communication terminal, and, more particularly, to a built-in type antenna assembly for a wireless communication terminal, designed to have a constant path of electrical signals and electric waves so as to exhibit uniform performance, and to reduce the number of components so as to reduce manufacturing costs while enhancing assembly efficiency.

2. Description of the Related Art

In general, wireless communication terminals are portable communication devices, which can transmit/receive audio, characters and images through wireless communication, such as personal communication service terminals, smart phones, international mobile telecommunication for the 2000s (IMT-2000), wireless local area network (LAN) terminals, and the like.

Such a wireless communication terminal has an antenna, such as a helical antenna or a dipole antenna, both of which are external antennas and formed as protrusions on the communication terminal, serving to enhance transmission and reception sensitivity.

However, although the above external antennas have an advantage of a non-directional radiation characteristic, since these antennas are protruded from the terminal, there are problems in that these antennas are very vulnerable to external force, inconvenient for a user to carry, and difficult to design an aesthetic appearance of the terminal.

In order to solve the problems as mentioned above, as for antennas embedded within the terminal, planar type antennas, such as micro-strip patch antennas, inverted F-type antennas, and the like have been suggested.

FIG. 1 is a cross-sectional view illustrating a built-in type antenna assembly embedded in a conventional wireless communication terminal. The conventional built-in type antenna assembly 1 comprises: a circuit printed board 10; an antenna body 30 assembled to the board 10 and having a through hole 35 formed through the antenna body 30; a planar antenna member 20 provided on the top surface of the antenna body 30; and a terminal unit 40, which includes upper and lower terminals 41 and 42 for electrically connecting the board 10 and the planar antenna member 20, a spring 43, and a terminal holder 44.

The upper terminal 41 has an upper end contacting the bottom surface of the planar antenna member 20, and the lower terminal 42 has a lower end contacting the top surface of the planar antenna 10. The spring 43 is disposed between the upper and lower terminals 41 and 42 so as to provide resilient force for maintaining contact between the upper terminal 41 and the planar antenna member 20 and contact between the lower terminal 42 and the board 10. The terminal holder 44 fitted into the through hole 35 is constituted by a hollow member such that the spring 43 can be disposed within the through hole 35 together with the upper and lower terminals 41 and 42 while preventing detachment of the upper and lower terminals 41 and 42.

In the conventional built-in type antenna assembly 1 constructed as described above, the electrical signals generated from the circuit of the board 10 must be transmitted to the planar antenna member 20 through the lower terminal 42, the spring 43, and the upper terminal 41.

However, other paths for the electrical signals can be formed such that the electrical signal from the board 10 is transmitted to the planar antenna member 20 through the lower terminal 42, the terminal holder 44, and the upper terminal 41, which is caused by the assembled construction of the terminal unit 40 that the terminal holder 44 contacts the upper and lower terminals 41 and 42.

In this case, if the electrical signals from the board 10 or signals received from the planar antenna member 20 are transmitted through other paths deviated from a predetermined path, the antenna has non-uniform performance varied according to usage environment and assembly method, leading to deteriorated reliability of the wireless communication terminals.

Moreover, the terminal unit 40 comprises a number of components, thereby lowering assembly efficiency on an assembly line while increasing manufacturing costs.

SUMMARY OF THE INVENTION

The present invention has been made to solve the above problems, and it is an object of the present invention to provide a built-in type antenna assembly of a wireless communication terminal, designed to have a constant path of electrical signals and electric waves, thereby providing uniform performance.

It is another object of the invention to provide the built-in type antenna assembly of a wireless communication terminal, designed to reduce the number of components, thereby reducing manufacturing costs while enhancing assembly efficiency.

In accordance with one aspect of the present invention, the above and other objects can be accomplished by the provision of a built-in type antenna assembly of a wireless communication terminal, comprising: a board; a case mounted on the board and having at least one disposing part formed through the case such that a portion of an upper surface of the board is exposed through the disposing part; an antenna member mounted on an upper surface of the case to radiate electrical signals from the board to the outside while receiving external signals; and a resilient part disposed within the disposing part so as to provide resilient force for maintaining contacts between an upper end of the resilient part and the antenna member and between a lower end of the resilient part and the board to electrically connect the board and the antenna member.

Preferably, the disposing part has at least one catching jaw formed on an inner surface of the disposing part to catch a portion of the resilient part.

Preferably, the disposing part is made of an insulator.

Preferably, the antenna member has a size approximately the same as that of the upper surface of the case.

Preferably, the antenna member is detachably assembled to a plurality of upper assembling jaws formed on the upper surface of the case. Alternatively, the antenna member may be integrally fixed to the upper surface of the case by adhesive bonding or may be integrally fixed to the upper surface of the case by thermal bonding.

Preferably, the resilient part is a meander spring bent to have at least one cycle of wave shape so as to impart the resilient force to a body of the resilient part extending from the lower end of the resilient part contacting the upper surface of the board to the upper end of the resilient part contacting the lower surface of the antenna member.

More preferably, the body of the resilient part has a diameter gradually decreasing from the upper end of the resilient part to the lower end of the resilient part. Alternatively, the body of the resilient part has a diameter gradually becoming constant from the upper end of the resilient part to the lower end of the resilient part.

Preferably, the resilient part is a bent-type meander spring having a body comprising bent portions alternately bent at an angle of 90° from a central portion of the body in opposite directions such that the bent portions do not face each other. Alternatively, the resilient part is a bent-type meander spring having a body comprising bent portions alternately bent at an angle of 90° at both sides of a central portion of the body such that the bent portions face each other. The resilient part is a bent-type meander spring having a body comprising bent portions alternately bent at different angles at both sides of a central portion of the body.

More preferably, the resilient part is a wide meander spring having a wide body.

Preferably, the resilient part is a meander spring bent at least one cycle so as to impart the resilient force to a body of the resilient part extending from the lower end of the resilient part contacting the upper surface of the board to the upper end of the resilient part contacting the lower surface of the antenna member.

Preferably, the lower end of the resilient part contacting the upper surface of the board and the upper end of the resilient part contacting the lower surface of the board are disposed on the vertical axis of the resilient part.

Preferably, the resilient part is a coil spring wound at least one cycle so as to impart the resilient force to a body of the resilient part extending from the lower end of the resilient part contacting the upper surface of the board to the upper end of the resilient part contacting the lower surface of the antenna member.

Preferably, the case has a plurality of disposing parts having different types of resilient parts assembled to the disposing parts.

Preferably, the case has a plurality of disposing parts having identical resilient parts assembled to the disposing parts.

BRIEF DESCRIPTION OF THE DRAWINGS

The foregoing and other objects and features of the present invention will be more clearly understood from the following detailed description taken in conjunction with the accompanying drawings, in which:

FIGS. 9*a*, 9*b*, 9*c* and 9*d* show the resilient parts employed to the antenna assembly of the wireless communication terminal according to the present invention, in which FIGS. 9*a* to 9*c* show bent-type meander spring, and FIG. 9*d* shows a wide meander spring.

DESCRIPTION OF THE PREFERRED EMBODIMENTS

Preferred embodiments will now be described in detail with reference to the accompanying drawings.

Figure 1:
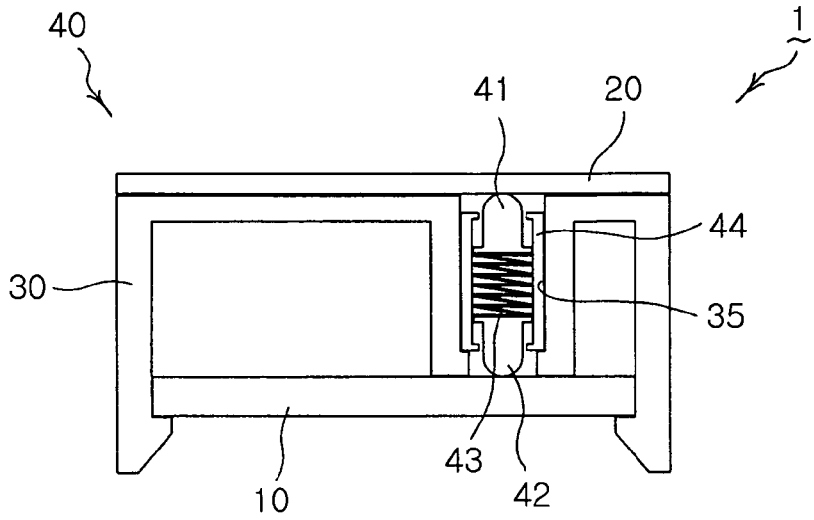
PRIOR ART FIG. 1
FIG. 1 is a cross-sectional view illustrating a conventional built-in type antenna assembly of a wireless communication terminal.
Figure 2:
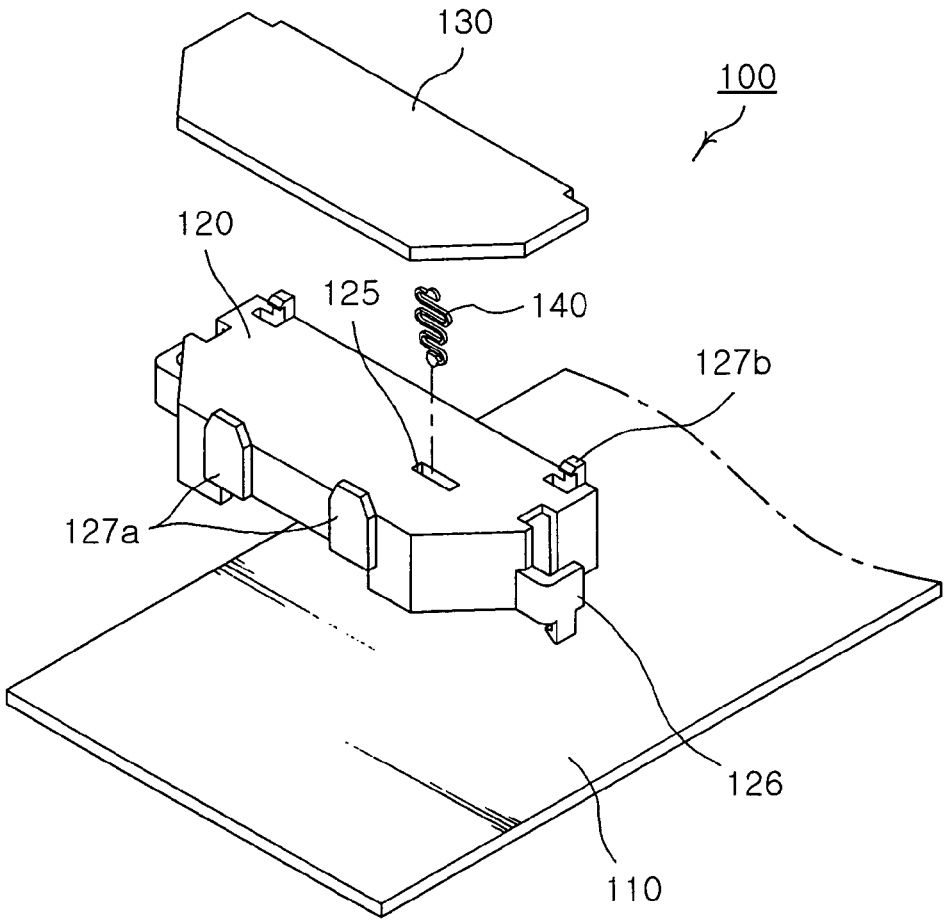
FIG. 2 is an exploded perspective view illustrating a built-in type antenna assembly of a wireless communication terminal according to a first embodiment of the present invention.
Figure 3:
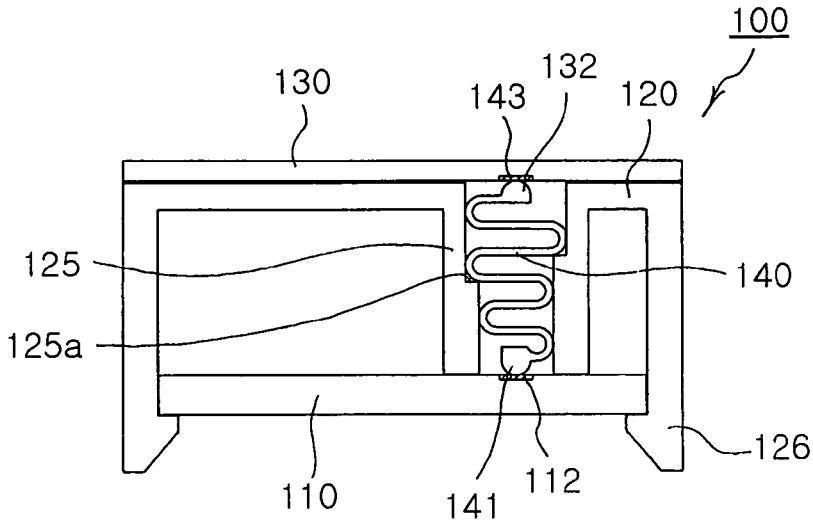
FIG. 3 is an exploded perspective view illustrating the built-in type antenna assembly of the wireless communication terminal according to the first embodiment of the present invention.

FIG. 2 is an exploded perspective view illustrating a built-in type antenna assembly of a wireless communication terminal according to a first embodiment of the present invention, and FIG. 3 is an exploded perspective view illustrating a built-in type antenna assembly of the wireless communication terminal according to the first embodiment of the present invention.

As shown in FIGS. 2 and 3, an antenna assembly 100 of the invention is embedded into a wireless communication terminal so as to provide a constant path through which electrical signals pass, and comprises a board 110, a case 120, an antenna member 130, and a resilient part 140.

The board 110 is a printed circuit board, which has a circuit of a predetermined pattern printed on an upper surface thereof, and a plurality of electronic components (not shown) mounted thereon, in which the circuit has at least one transceiver terminal for transmitting electrical signals to the outside while receiving external signals.

The case 120 is a structure detachably assembled to an upper surface of the board 110 such that the antenna member 130 is provided to the case 120.

The case 120 has at least one hollow disposing part 125 formed through the case 120 such that a portion of the upper surface of the board 110 is exposed through the disposing part 125. At this time, the disposing part 125 corresponds to a transceiver terminal 112, which is related to the antenna member 130, of the circuit printed on the upper surface of the board 110.

Here, both the disposing part 125 and the case 120 are preferably made of insulators. The disposing part 125 preferably has at least one catching jaw 125*a* formed on an inner surface of the disposing part 125 to catch a portion of the resilient part 140 received in the disposing part 125.

Although the case 120 of the present embodiment is illustrated in FIGS. 2 and 3 as having an approximately rectangular box shape opened at a lower portion thereof, the present invention is not limited to this construction, and the case 120 may have various shapes according to the shapes of the wireless communication terminals. Additionally, the disposing part 125 also has various shapes according to the shape of the resilient part 140 received within the disposing part 125.

Both left and right sides of the case 120 are formed with a plurality of lower assembling jaws 126 for easy assembly and disassembly with the board 110, and the upper surface of the case 120 is formed with a plurality of upper assembling jaws 127*a* and 127*b* for convenient fixation of the planar antenna member 130 thereto.

The antenna member 130 is mounted on the upper surface of the case 120 so as to transform the electrical signals from the board 110 to electric waves, and then to transmit them to the outside while receiving electric waves in a specific frequency band transmitted from the outside.

The size of the antenna member 130 is preferably approximately the same as that of the upper surface of the case 120 so as to prevent the antenna member 130 from interfering with the electrical components (not shown) mounted on the board 110. That is, if the antenna member 130 is larger than the case 120, the antenna member 130 is extended from the side of the case, and interferes with the electrical components.

Here, it is desirable that the antenna member 130 of the invention is a planar type antenna, such as a micro-strip patch antenna or an inverted F-type antenna.

Meanwhile, the resilient part 140 received within the disposing part 125 of the case 120 is a resilient member, which has a lower end 141 contacting the transceiver terminal 112 formed on the upper surface of the board 110, and an upper end 132 contacting another transceiver terminal 132 formed on the lower surface of the antenna member 130 so as to electrically connect the antenna member 130 serving to receive and radiate the electrical wave to the board 110 serving to generate the electrical signals.

The resilient part 140 is compressed within the disposing part 125 upon coupling between the board 110 and the case 120, and provides resilient force for maintaining contacts between the lower end 141 and the board 110 and between the upper end 143 and the antenna member 130 to electrically connect the board 110 and the antenna member 130.

Here, the upper and lower ends 141 and 143 of the resilient part 140 are preferably arranged on the identical vertical axis of the resilient part 140, and have an arc-shaped cross section so as to have point contacts or to be welded to the upper surface of the substrate 110 and the lower surface of the antenna member 130, respectively.

The catching jaw 125*a* formed in the inner surface of the disposing part 125A catches a portion of the resilient part 140 received within the disposing part 125 of the case 120, preventing the resilient part 140 from being released downward from the disposing part 125 upon assembly, while the antenna member 130 mounted on the upper surface of the case 120 prevents the resilient part 140 from being released upward from the disposing part 125. Accordingly, delivery of the antenna assembly 100 without the board 110 to a final production stage can be securely performed without loss of the resilient part 140.

The resilient part 140 acts as a single path through which the electrical signals from the board 110 are transmitted to the antenna member 130, and the received external electric waves are transmitted to the board 110, while radiating the electrical signals transmitted to the resilient part 140 to the outside. As a result, additional radiation through the resilient part 140 is performed at the same time with basic radiation through the antenna member 130, thereby remarkably enhancing the performance of the antenna assembly.

At this time, the radiation performance from the resilient part 140 can be varied according to the shape, length, and diameter of a body of the resilient part 140.

With regard to this, the resilient part 140 is a meander spring bent to have at least one cycle of a predetermined wave shape so as to impart a predetermined resilient force to the body of the resilient part 140 extending from the lower end 141 contacting the upper surface of the board 110 to the upper end 143 contacting the lower surface of the antenna member 130.

The body of the resilient part 140 may have, as shown in FIGS. 2 and 3, a diameter gradually decreasing from the upper end 143 to the lower end 141.

Figure 4:
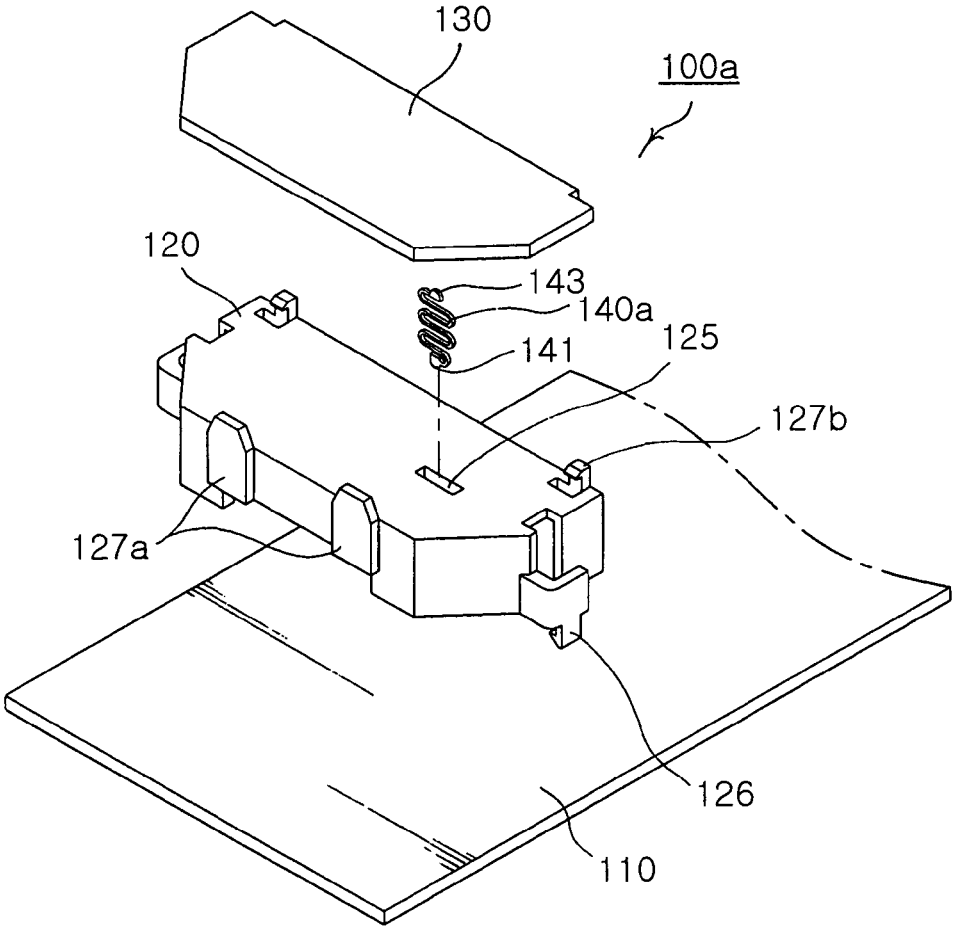
FIG. 4 is an exploded perspective view illustrating a built-in type antenna assembly of the wireless communication terminal according to a second embodiment of the present invention.
Figure 5:
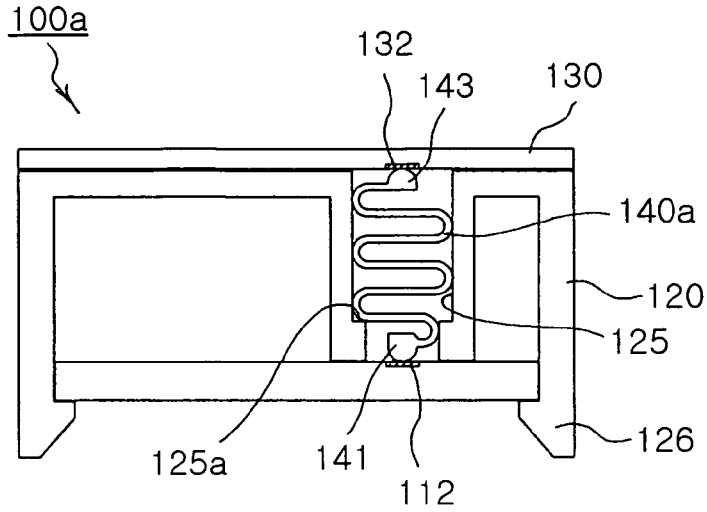
FIG. 5 is an exploded perspective view illustrating the built-in type antenna assembly of the wireless communication terminal according to the second embodiment of the present invention.

Alternatively, the body of the resilient part 140*a* may have, as shown in FIGS. 4 and 5, a diameter gradually becoming constant from the upper end 143 to the lower end 141.

In this case, since the resilient part 140*a* having a constant diameter is longer than the resilient part 140 having a variable diameter, radiation performance of the resilient part 140*a* is higher than that of the resilient part 140.

Figure 9:
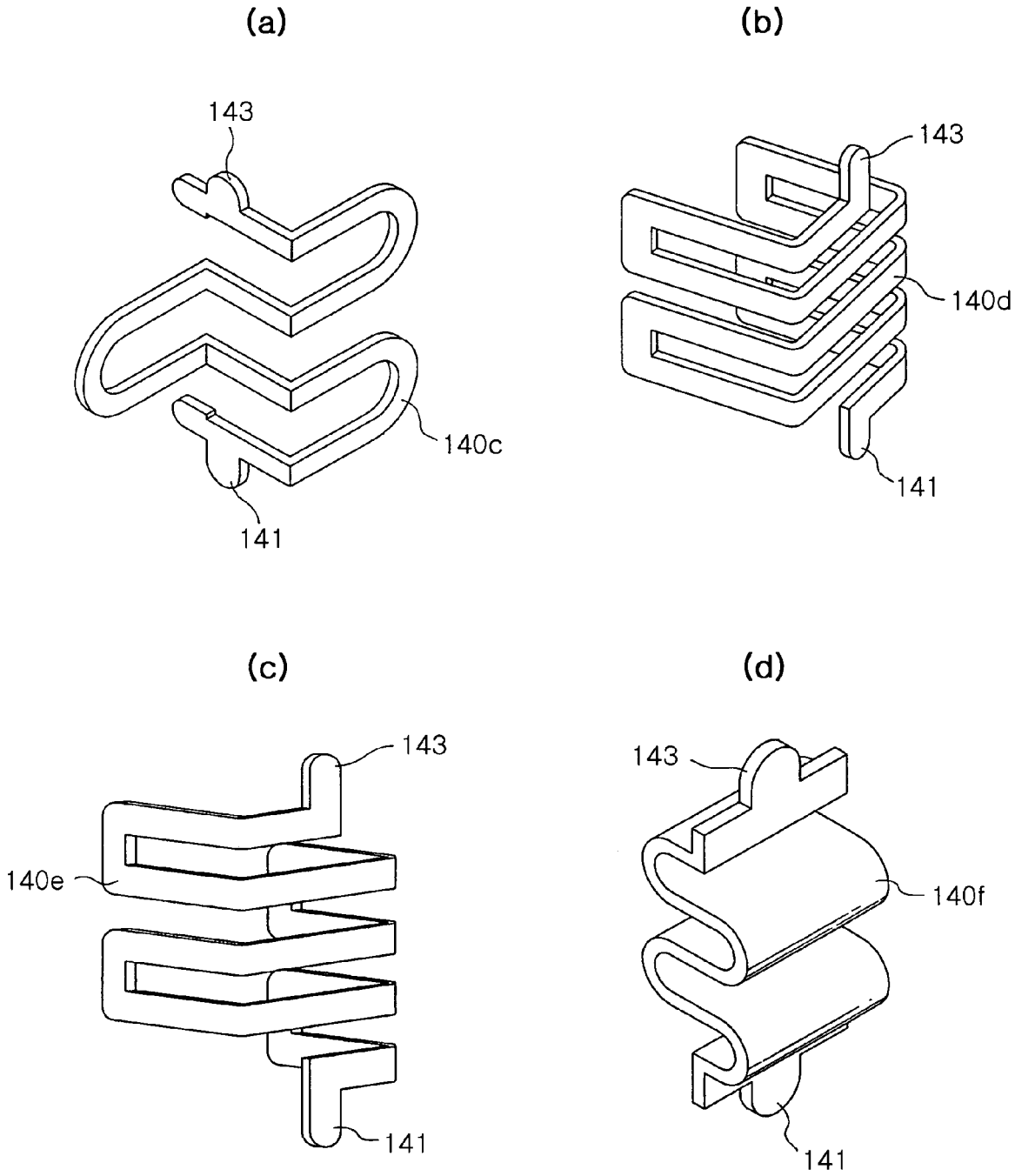

Moreover, as shown in FIG. 9*a*, the antenna assembly of the invention may employ a resilient part 140*c*, which is a bent-type meander spring having a body comprising bent portions alternately bent at an angle of 90° from a central portion of the body in opposite directions such that the bent portions do not face each other, in which the body of the meander spring is bent in the wave shape from the upper end 143 to the lower end 141. Alternatively, as shown in FIG. 9*b*, the antenna assembly of the invention may employ a resilient part 140*d*, which is a bent-type meander spring having a body comprising bent portions alternately bent at an angle of 90° at both sides of a central portion of the body such that the bent portions face each other, in which the body of the meander spring is bent in the wave shape from the upper end 143 to the lower end 141. Alternatively, as shown in FIG. 9*c*, the antenna assembly of the invention may employ a resilient part 140*e*, which is a bent-type meander spring having a body comprising bent portions alternately bent at different angles at both sides of a central portion of the body, in which the body of the meander spring is bent in the wave shape from the upper end 143 to the lower end 141.

Additionally, as shown in FIG. 9*d*, the antenna assembly of the invention may employ a resilient part 140*f*, which is a wide meander spring having a body of a predetermined width, in which the body of the meander spring is bent in a sinuous wave shape from the upper end 143 to the lower end 141.

Figure 6:
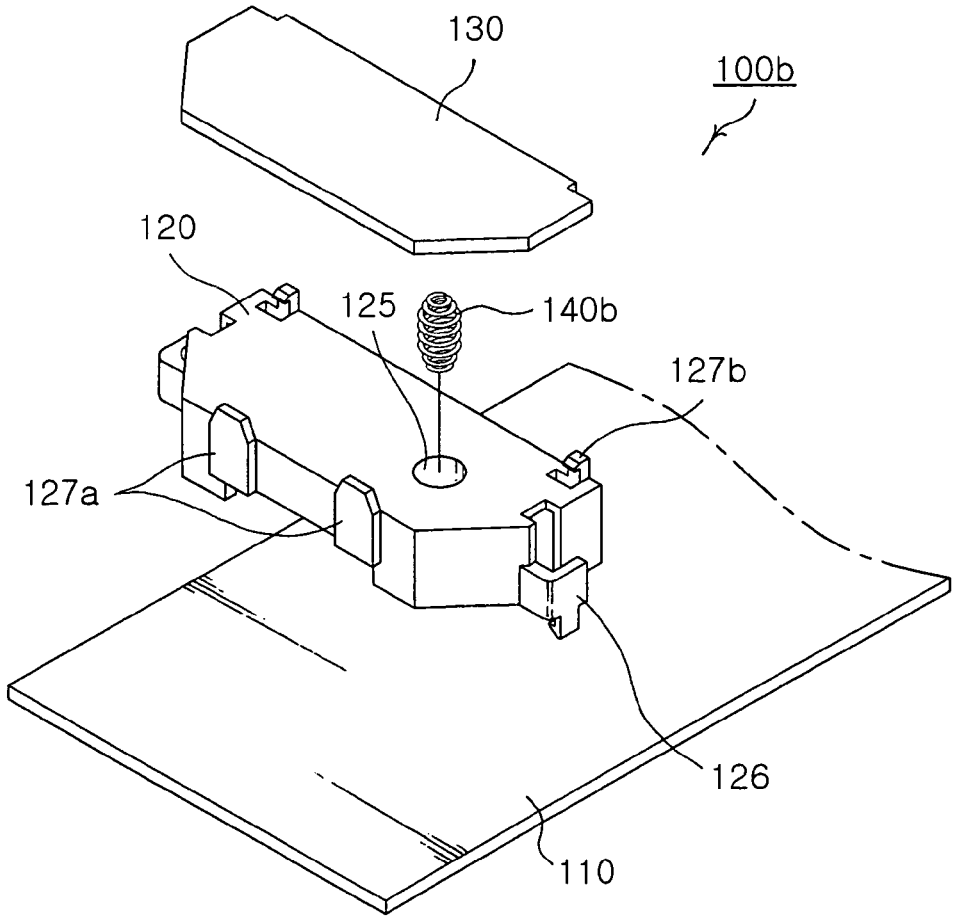
FIG. 6 is an exploded perspective view illustrating a built-in type antenna assembly of the wireless communication terminal according to a third embodiment of the present invention.
Figure 7:
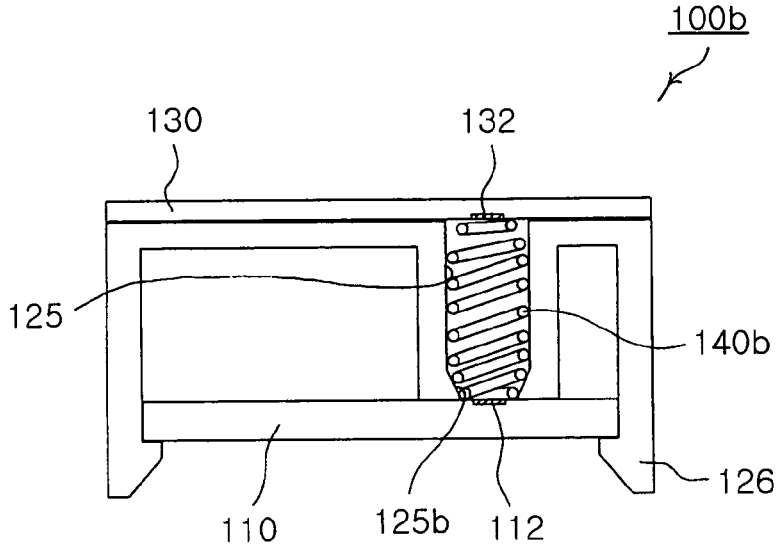
FIG. 7 is an exploded perspective view illustrating the built-in type antenna assembly of the wireless communication terminal according to the third embodiment of the present invention.

As shown in FIGS. 6 and 7, the antenna assembly of the invention may employ a resilient part 140*b*, which is a cylindrical coil spring wound at least one cycle so as to impart resilient force to the body of the resilient part extending from the upper end 143 contacting the lower surface of the antenna member 130 to the lower end 141 contacting the upper surface of the board 110.

When the antenna assembly of the invention employs the cylindrical coil spring type resilient part 140*b*, an inner lower portion of the disposing part 125 has a smaller diameter 125*b* by which a portion of the resilient part 140*b* is caught to prevent the resilient part 140*b* from being released downward from the disposing part 125 upon disassembly from the board 110.

Here, since the disposing part 125 receives the resilient part 140, 140*b*, 140*c*, 140*d*, 140*e* or 140*f* therein, it has various hollow shapes corresponding to the different shapes of the resilient parts 140, 140*b*, 140*c*, 140*d*, 140*e* and 140*f*. The length of each resilient part 140, 140*b*, 140*c*, 140*d*, 140*e* or 140*f* is preferably longer than the disposing part 125 such that a portion of either end of the resilient part is exposed above or below the disposing part 125 in an unloaded state after being inserted into the disposing part 125.

Meanwhile, assembly operation of an antenna assembly 100, 100*a* or 100*b*, as shown in FIGS. 2 to 7, starts from preparing the case 120 having the disposing part 125 configured corresponding to the shape of the resilient part 140, 140*a* or 140*b* to be employed.

The resilient part 140, 140*a* or 140*b* is inserted from above into the disposing part 125 formed through the case 120, and received within the disposing part 125, in which the upper and lower ends of the resilient part 140, 140*a* or 140*b* are exposed to above or below the disposing part 125 in an unloaded state.

Then, the antenna member 130 having the approximately same size as that of the upper surface of the case is disposed directly above the case 120, and is assembled to the case 120 by compressing such that outer edges of the antenna member 130 are latched and fixed to the plurality of assembling jaws 127*a* and 127*b* formed on the upper surface of the case 120.

The antenna member 130 may be integrally fixed to the case 120 with adhesives (not shown) interposed therebetween by adhesive bonding or by thermal bonding.

In this case, the upper end 143 of resilient part 140, 140*a* or 140*b* received within the disposing part 125 contacts the transceiver terminal 132 formed under the bottom surface of an associated antenna member 130, which is caused by the fact that when assembling the antenna member 130 to the case 120, the transceiver terminal 132 of the antenna member 130 is identical in position to the upper portion of the disposing part 125.

The contact between the transceiver terminal 132 of the antenna member 130 and the upper end 143 of the resilient part 140, 140*a* or 140*b* is maintained by resilient force generated by the resilient part 140, 140*a* or 140*b* compressed in a state that a portion of the body of the resilient part 140, 140*a* or 140*b* is caught by the catching jaw 125 of the disposing part 125*a* upon assembly of the antenna member 130 to the case 120.

Additionally, since the resilient part 140, 140*a* or 140*b* is caught by the catching jaw 125, and prevented from being released downward from the disposing part thereof, the antenna assembly, simply with the case, the antenna member, and the resilient part temporarily assembled thereto, can be securely delivered to a final production stage.

Then, the case 120 having the antenna member 130 and the resilient part 140, 140*a* or 140*b* assembled thereto is lowered in the vertical direction to the board 110 having an RF circuit of a predetermined pattern printed thereon, the lower assembling jaws 126 provided to the lower portion of the case 120 are latched, and assembled to the outer edge of the board 110 by virtue of resilient force.

In this case, since the transceiver terminal 112 of the circuit printed on the upper surface of the board 110 contacts the lower end 141 of the resilient part 140, 140*a* or 140*b* exposed below the disposing part 125, the board 110, the resilient part 140, 140*a* or 140*b*, and the antenna member 130 constitute a circuit through which electrical signals and electric waves are transmitted.

At this time, contact between the transceiver terminal 112 of the board 110 and the lower end 141 of the resilient part 140, 140*a* or 140*b* can be maintained by resilient force of the resilient part 140, 140*a* or 140*b*, which is compressed again upon assembly between the board 110 and the case 120.

Figure 8A:
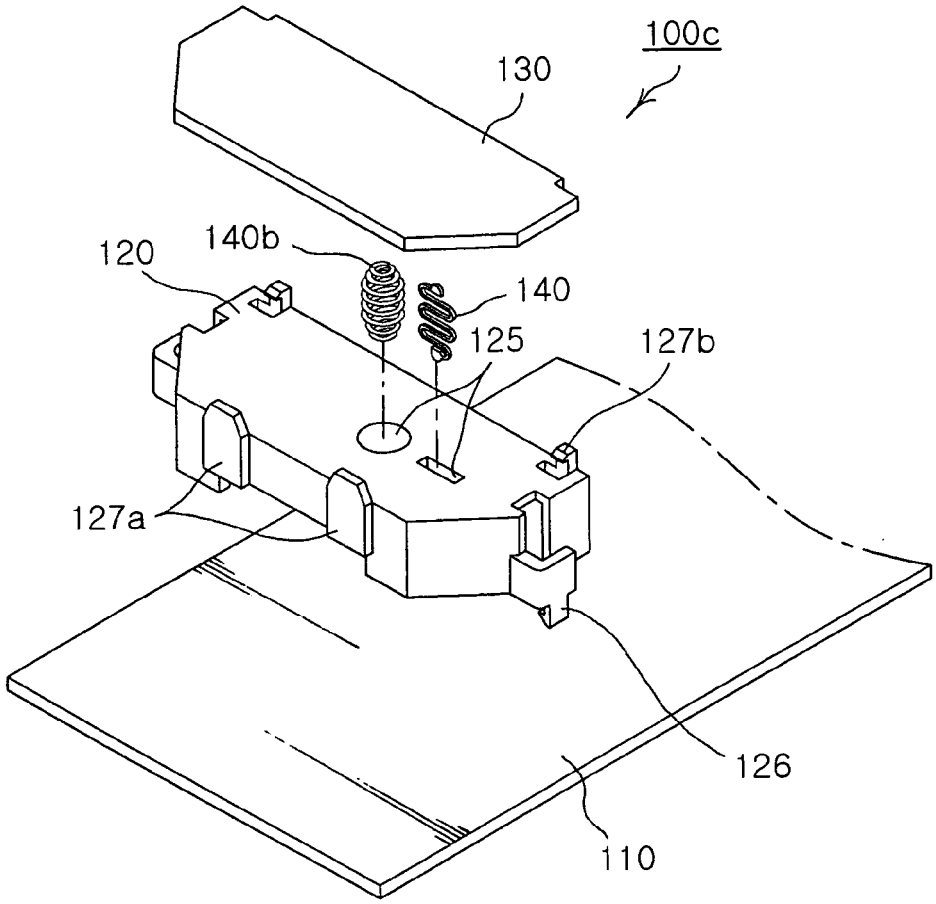
FIG. 8*a* is an exploded perspective view illustrating the antenna assembly having different types of resilient parts received therein according to the present invention.
Figure 8B:
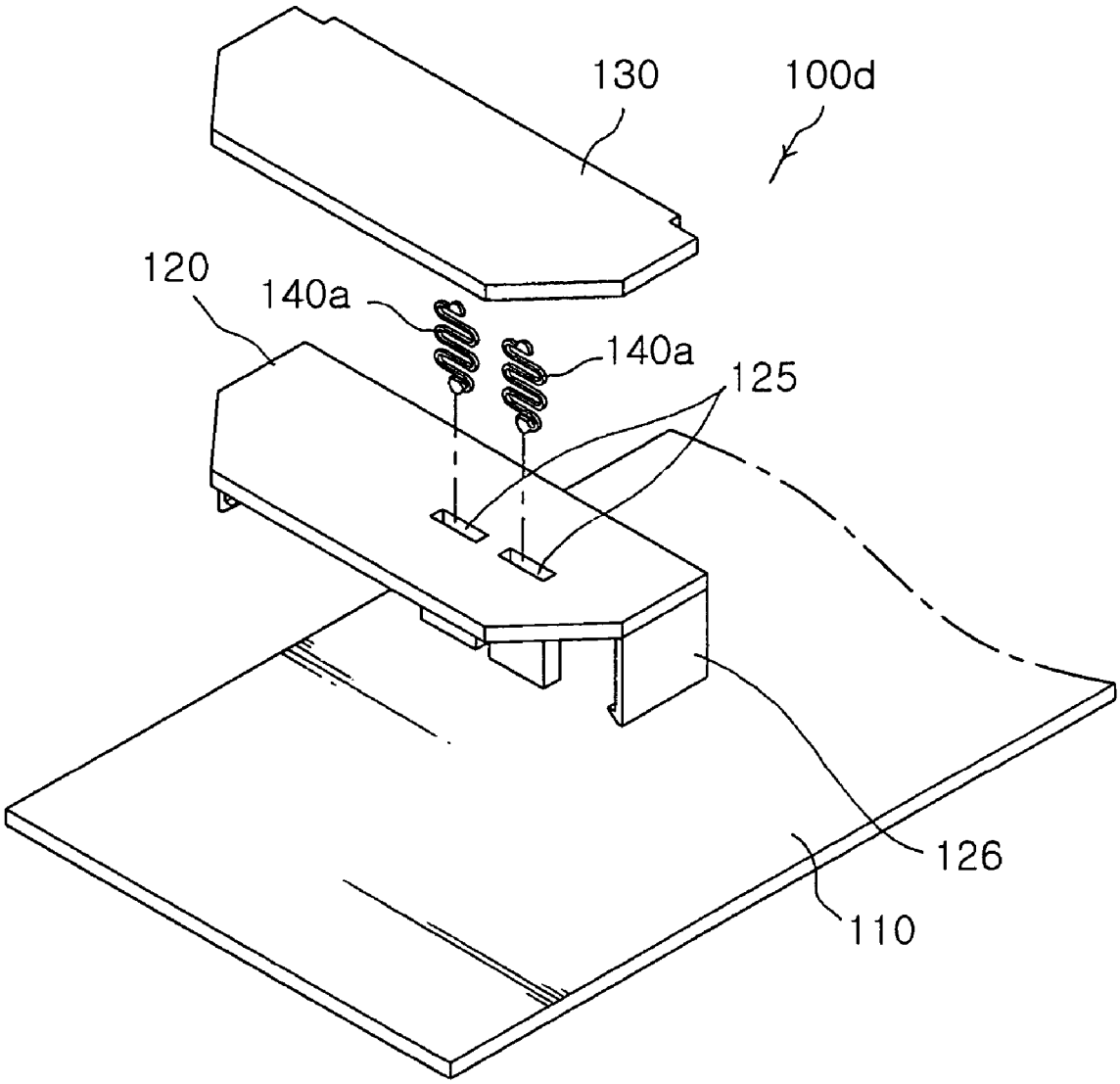
FIG. 8*b* is an exploded perspective view illustrating the antenna assembly having identical resilient parts received therein according to the present invention.

Meanwhile, assembly operation of an antenna assembly 100*c* or 100*d* starts from preparing a case 120 having a plurality of disposing parts 125. Then, as shown in FIG. 8*a*, a plurality of resilient parts having different shapes, for example, the resilient part 140 having a meander spring shape and the resilient part 140*b* having a coil spring shape are received in the disposing parts 125, respectively. Alternatively, as shown in FIG. 8*b*, a plurality of resilient parts having the identical shape are received in the disposing parts 125, respectively.

In this case, electrical signal radiation performance of the antenna assembly 100*c* or 100*d* is increased in proportion to the number of the resilient parts, enhancing reliability of the antenna assembly.

Meanwhile, with the antenna assembly 100, 100*a*, 100*b*, 100*c* or 100*d* assembled to a wireless communication terminal, when a communication button of the wireless communication terminal is pressed, electrical signals generated from the board 110 by operation of the communication button are transmitted to the antenna member 130 contacting the upper end 143 of the resilient part 140 through the resilient part 140 having the lower end 141 thereof contacting the transceiver terminal 112 of the board 110.

Then, the electrical signals transmitted to the antenna member 130 are transformed into electric waves in a predetermined frequency band by the antenna member 130, and are then radiated to the outside.

Additionally, the antenna member 130 receives electric waves in a predetermined frequency band among electric waves radiated from the outside, and the received electric waves are transmitted to the circuit of the board through the resilient part. The transmitted electric waves are transformed into electrical signals through demodulation and decoding, and are transmitted in the form of audio, characters or images to the user.

As apparent from the above description, according to the invention, the electrical signals generated by the board and the electric waves received into the antenna member are transmitted only through the resilient part received in the disposing part of the case made of an insulator, so that a constant path of the electrical signals and the electric waves can be ensured, thereby providing uniform radiation and reception performance of the antenna assembly.

Furthermore, the number of components constituting the resilient part electrically connecting the antenna member and the board is reduced in comparison to the conventional technology, thereby reducing manufacturing costs while enhancing assembly efficiency on an assembly line.

It should be understood that the embodiments and the accompanying drawings have been described for illustrative purposes and the present invention is limited by the following claims. Further, those skilled in the art will appreciate that various modifications, additions and substitutions are allowed without departing from the scope and spirit of the invention as set forth in the accompanying claims.

What is claimed is:

1. A built-in type antenna assembly of a wireless communication terminal, comprising:

a board;

a case mounted on the board and having at least one disposing part formed through the case such that a portion of an upper surface of the board is exposed through the disposing part;

an antenna member mounted on an upper surface of the case to radiate electrical signals from the board to the outside while receiving external signals; and a resilient part disposed within the disposing part so as to provide resilient force for maintaining contacts between an upper end of the resilient part and the antenna member and between a lower end of the resilient part and the board to electrically connect the board and the antenna member;

wherein the resilient part is a meander spring bent to have at least one cycle of wave shape so as to impart the resilient force to a body of the resilient part extending from the lower end of the resilient part contacting the upper surface of the board to the upper end of the resilient part contacting the lower surface of the antenna member;

wherein the resilient part is a bent-type meander spring having a body comprising bent portions alternately bent at an angle of 90° from a central portion of the body in opposite directions such that the bent portions do not face each other;

wherein the disposing part has at least one catching jaw formed on an inner surface of the disposing part to catch a portion of the resilient part.

2. The antenna assembly as set forth in claim 1, wherein the disposing part is made of an insulator.

3. The antenna assembly as set forth in claim 1, wherein the antenna member is detachably assembled to a plurality of upper assembling jaws formed on the upper surface of the case.

4. The antenna assembly as set forth in claim 1, wherein the antenna member is fixed to the upper surface of the case by adhesive bonding.

5. The antenna assembly as set forth in claim 1, wherein the antenna member is fixed to the upper surface of the case by thermal bonding.

6. The antenna assembly as set forth in claim 1, wherein the body of the resilient part has a diameter gradually decreasing from the upper end of the resilient part to the lower end of the resilient part.

7. The antenna assembly as set forth in claim 1, wherein the body of the resilient part has a diameter gradually becoming constant from the upper end of the resilient part to the lower end of the resilient part.

8. The antenna assembly as set forth in claim 1, wherein the case has a plurality of disposing parts having different types of resilient parts assembled to the disposing parts.

9. The antenna assembly as set forth in claim 1, wherein the case has a plurality of disposing parts having identical resilient parts assembled to the disposing parts.

* * * * *